US008843042B2

(12) United States Patent
Nawa et al.

(10) Patent No.: US 8,843,042 B2
(45) Date of Patent: Sep. 23, 2014

(54) IMAGE HEATING APPARATUS, BEARING MOUNTING STRUCTURE AND RETAINING RING

(75) Inventors: Masahiro Nawa, Toride (JP); Kazuaki Aoki, Moriya (JP); Shouhei Takeda, Toride (JP); Yasuo Nami, Toride (JP); Naoyuki Yamamoto, Kashiwa (JP); Koji Takematsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 13/479,609

(22) Filed: May 24, 2012

(65) Prior Publication Data

US 2012/0328338 A1 Dec. 27, 2012

(30) Foreign Application Priority Data

Jun. 24, 2011 (JP) ..... 2011-140350

(51) Int. Cl.
*G03G 15/20* (2006.01)
*G03G 15/00* (2006.01)

(52) U.S. Cl.
CPC ..... *G03G 15/2053* (2013.01)
USPC ..... 399/328; 399/167

(58) Field of Classification Search
USPC ..... 399/122, 167, 328, 330
See application file for complete search history.

(56) References Cited

U.S. PATENT DOCUMENTS

| | | | | |
|---|---|---|---|---|
| 7,196,296 | B2 | 3/2007 | Yamamoto | |
| 7,199,339 | B2 | 4/2007 | Shirakata et al. | |
| 7,205,514 | B2 | 4/2007 | Suzuki et al. | |
| 7,238,924 | B2 | 7/2007 | Kondo et al. | |
| 7,268,326 | B2 | 9/2007 | Yamamoto et al. | |
| 7,268,327 | B2 | 9/2007 | Yamamoto et al. | |
| 7,271,371 | B2 | 9/2007 | Takematsu et al. | |
| 7,319,210 | B2 | 1/2008 | Hosoi et al. | |
| 7,397,017 | B2 | 7/2008 | Hosoi et al. | |
| 7,433,643 | B2 | 10/2008 | Matsuno et al. | |
| 7,442,905 | B2 | 10/2008 | Wakahara et al. | |
| 7,462,804 | B2 | 12/2008 | Shirakata et al. | |
| 7,465,906 | B2 | 12/2008 | Wakahara et al. | |
| 7,539,449 | B2 | 5/2009 | Aoki | |
| 7,657,217 | B2 | 2/2010 | Wakahara et al. | |
| 7,756,460 | B2 * | 7/2010 | Matsuno et al. | 399/330 |
| 8,099,008 | B2 | 1/2012 | Nakase et al. | |
| 2006/0204292 | A1 * | 9/2006 | Kato et al. | 399/328 |
| 2007/0048047 | A1 | 3/2007 | Matsuno et al. | |
| 2009/0022528 | A1 | 1/2009 | Matsuno et al. | |
| 2011/0091225 | A1 | 4/2011 | Yamamoto | |
| 2011/0091230 | A1 | 4/2011 | Yamamoto | |
| 2012/0118877 | A1 | 5/2012 | Nakase et al. | |

FOREIGN PATENT DOCUMENTS

| | | | |
|---|---|---|---|
| JP | 2007-57644 | A | 3/2007 |

* cited by examiner

*Primary Examiner* — Hoang Ngo
(74) *Attorney, Agent, or Firm* — Fitzpatrick, Cella, Harper & Scinto

(57) ABSTRACT

An image heating apparatus includes a roller, a heating portion disposed within the roller, a bearing portion fitted around an end portion of the roller to rotably support the roller, and a retaining ring attached at an axially predetermined position of the roller to restrict the roller from moving in a axial direction of the roller with respect to the bearing portion. The retaining ring includes first and second projections fitted into a hole portion of the roller. Profiles of side surfaces of these first and second projections abutting edges of the hole portion in a circumferential direction are recessed in the circumferential direction.

8 Claims, 11 Drawing Sheets

IMAGE HEATING APPARATUS, BEARING MOUNTING STRUCTURE AND RETAINING RING

BACKGROUND OF THE INVENTION

1. Field of the Invention

The present invention relates to an image heating apparatus that implements a heating process on a toner image on a recording member by contacting a roller onto the recording member and more specifically to a configuration thereof for mounting and axially positioning a bearing portion at an end portion of the roller by a retaining ring.

2. Description of the Related Art

An image forming apparatus that forms and transfers a toner image on a recording member is now widely used. The apparatus then conveys the recording member on which the toner image has been transferred to a heating nip portion of an image heating apparatus and fixes the image on the recording member by nipping and heating the recording member at the heating nip portion. Besides such fixing apparatus, the image heating apparatus is practically used also as a gloss treatment apparatus that applies a desirable degree of gloss by heating a semi-fixed or fixed image or as a reheating apparatus that eliminates residual stress by reheating a fixed image.

The image heating apparatus is arranged in general so that the roller formed of metal is heated in advance and the recording member is conveyed to the heating nip portion formed by press-contacting a pressing member to the roller. The roller is rotably supported by bearing portions disposed at both end portions of the roller.

Japanese Patent Application Laid-open No. 2007-57644 discloses a fixing apparatus having a heating nip portion, through which a recording member is nipped, formed by press-contacting a pressure member to a roller. Here, the roller is provided with one T-shaped cutaway and two I-shaped holes disposed in a circumferential direction at an end thereof. Then, an elastically openable retaining ring having three projections is fitted around the roller in a state in which the respective projections are fitted into the cutaway and the holes. That is, the retaining ring is attached to an outer circumferential surface of the roller in the state in which the projections are inserted into the holes. The retaining ring positions a bearing portion at a predetermined position in an axial direction of the roller to prevent the roller from falling out in the axial direction. The bearing portion has a heat insulating member fitted around the roller and a bearing member fitted around the heat insulating member.

Here, it is preferable to form the roller thinly in order to improve heating responsibility. However, if the roller is thinned, the retaining ring described in Japanese Patent Application Laid-open No. 2007-57644 has a problem that the projections of the retaining ring cannot be fully caught by thin edges of holes of the thinned roller.

SUMMARY OF THE INVENTION

The present invention provides an image heating apparatus that includes a roller configured to rotate in contact with contacting a recording member and to include a hole portion formed through an outer circumference of the roller, a heating portion disposed within the roller and configured to heat the roller, a bearing portion configured to fit around an end portion of the roller and to rotably support the roller and a retaining ring formed platelike and configured to attach at an axially predetermined position of the roller to restrict the roller from moving in an axial direction with respect to the bearing portion. The retaining ring includes a body formed into a shape of C, a first projection configured to project inwardly at a first end portion of the body and to fit into the hole portion of the roller, and a second projection configured to project inwardly at a second end portion of the body and to fit into the hole portion of the roller. Side surfaces of the first and second projections abutting an edge of the hole portion in the circumferential direction are recessed in the circumferential direction so that the retaining ring does not come out of the roller.

Further features of the present invention will become apparent from the following description of exemplary embodiments with reference to the attached drawings.

DESCRIPTION OF THE EMBODIMENTS

First Embodiment

Image Forming Apparatus

Figure 1:
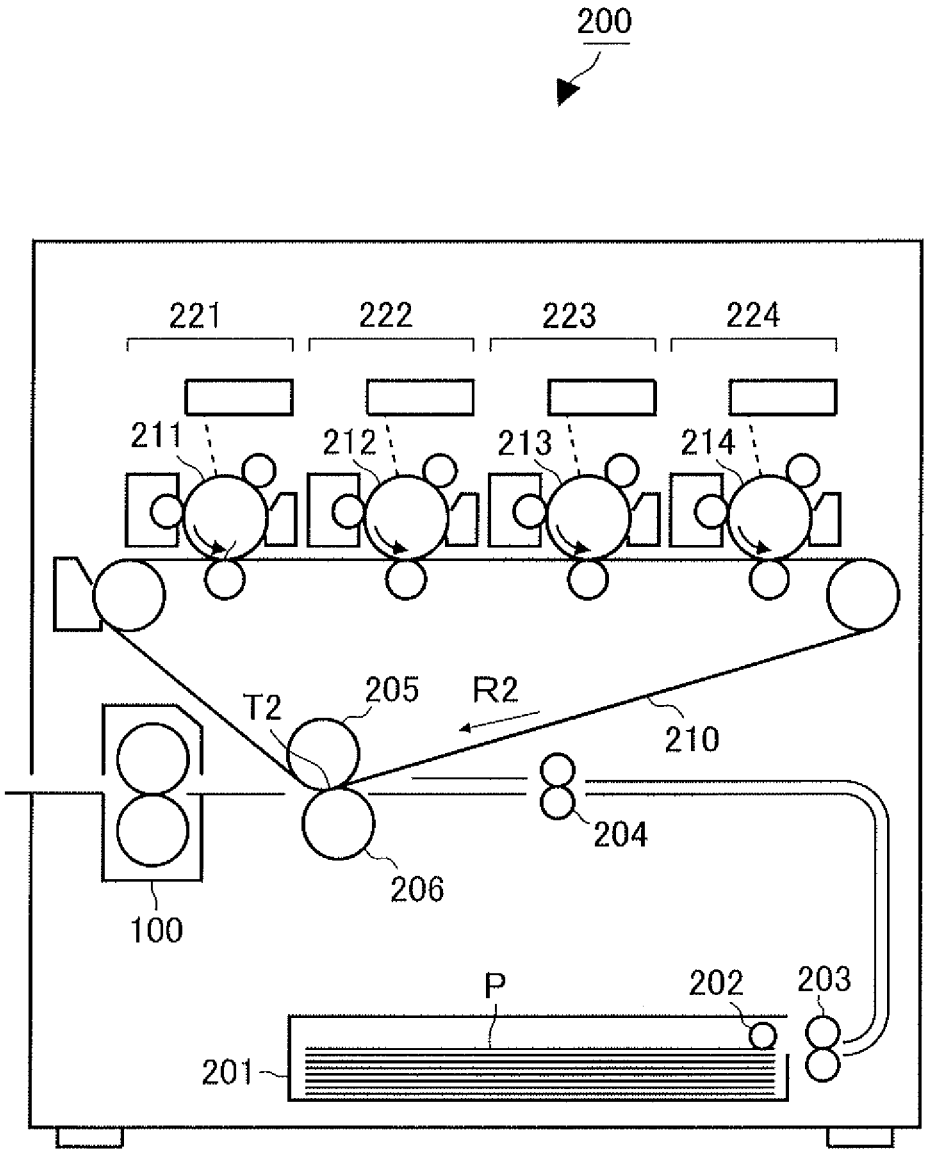
FIG. 1 is a schematic diagram illustrating an overall configuration of an image forming apparatus.

FIG. 1 is a schematic diagram illustrating an overall configuration of an image forming apparatus 200. As shown in FIG. 1, the image forming apparatus 200 is a tandem intermediate transfer-type full-color printer in which yellow, magenta, cyan and black image forming portions 221, 222, 223 and 224 are arrayed along an intermediate transfer belt 210. The image forming portions 221, 222, 223 and 224 are constructed substantially in the same manner, except of that the colors of the toners used in respective developers.

A yellow toner image is formed on a photosensitive drum 211 and is transferred to an intermediate transfer belt 210 in the image forming portion 221. A magenta toner image is formed and is transferred to the intermediate transfer belt 210 in the image forming portion 222 in the same manner with the image forming portion 221. Cyan and black toner images are also formed and are transferred to the intermediate transfer belt 210 in the image forming portions 223 and 224 in the same manner with the image forming portion 221.

The four color toner images carried on the intermediate transfer belt 210 are conveyed to a secondary transfer portion T2 and are secondarily transferred to a recording member P all together. The recording member P is pulled out of a recording member cassette 201 by pickup rollers 202 and is fed to a registration roller 204 by being separated one by one by a separation roller 203. The registration roller 204 sends the recording member P to the secondary transfer portion T2 by synchronizing timing of the conveyance of the toner image of the intermediate transfer belt 210.

The recording member P, on which the four color toner images are secondarily transferred, self-strips from the intermediate transfer belt 210 and is sent to the fixing apparatus 100. The fixing apparatus 100 heats up and presses the recording member P to melt the toner and to fix an image on the surface of the recording member P. The recording member P is then discharged out of the apparatus body.

<Fixing Apparatus>

Figure 2:
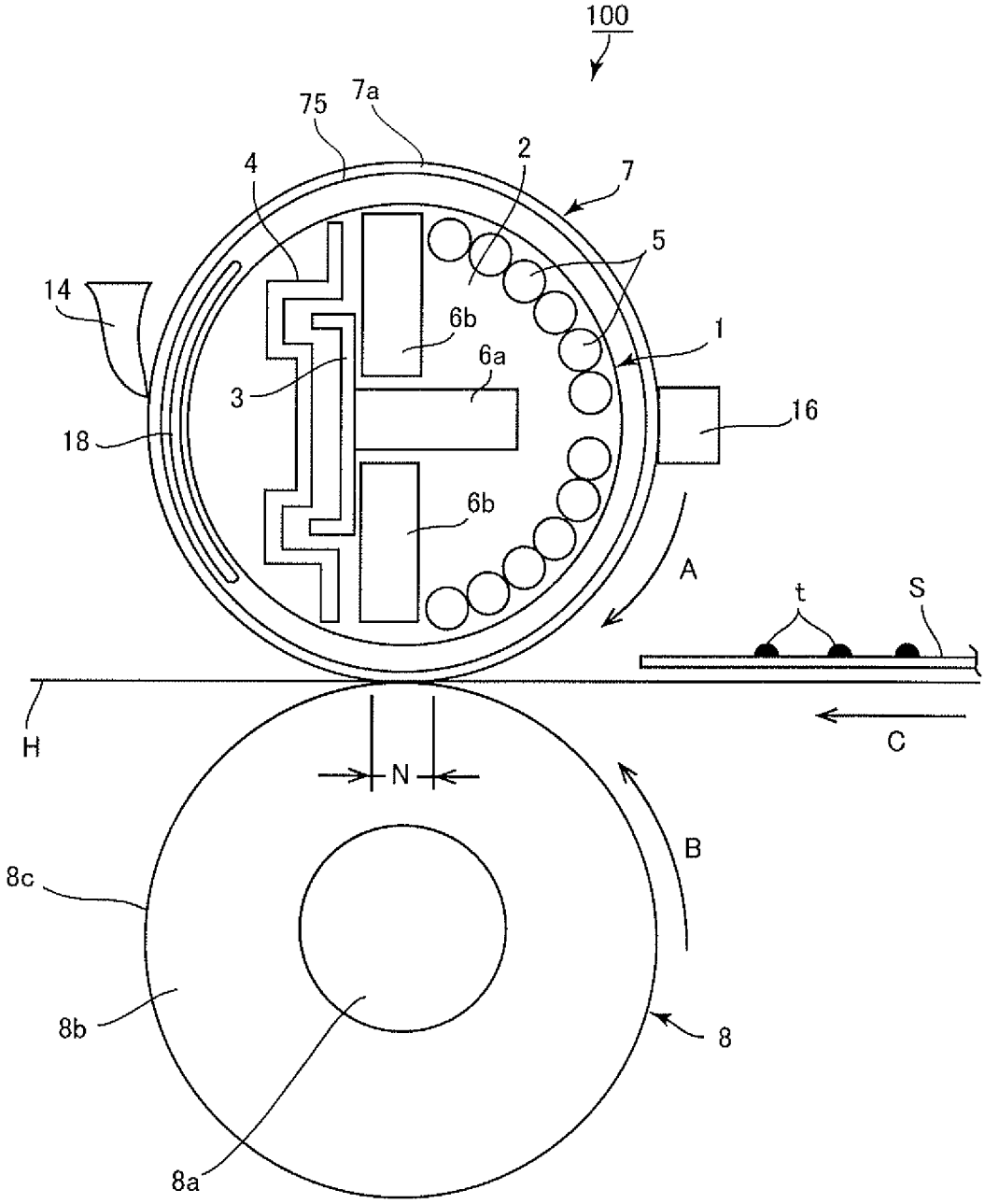
FIG. 2 is a schematic diagram illustrating a sectional configuration of a fixing apparatus taken in a direction vertical to an axis thereof.
Figure 3:
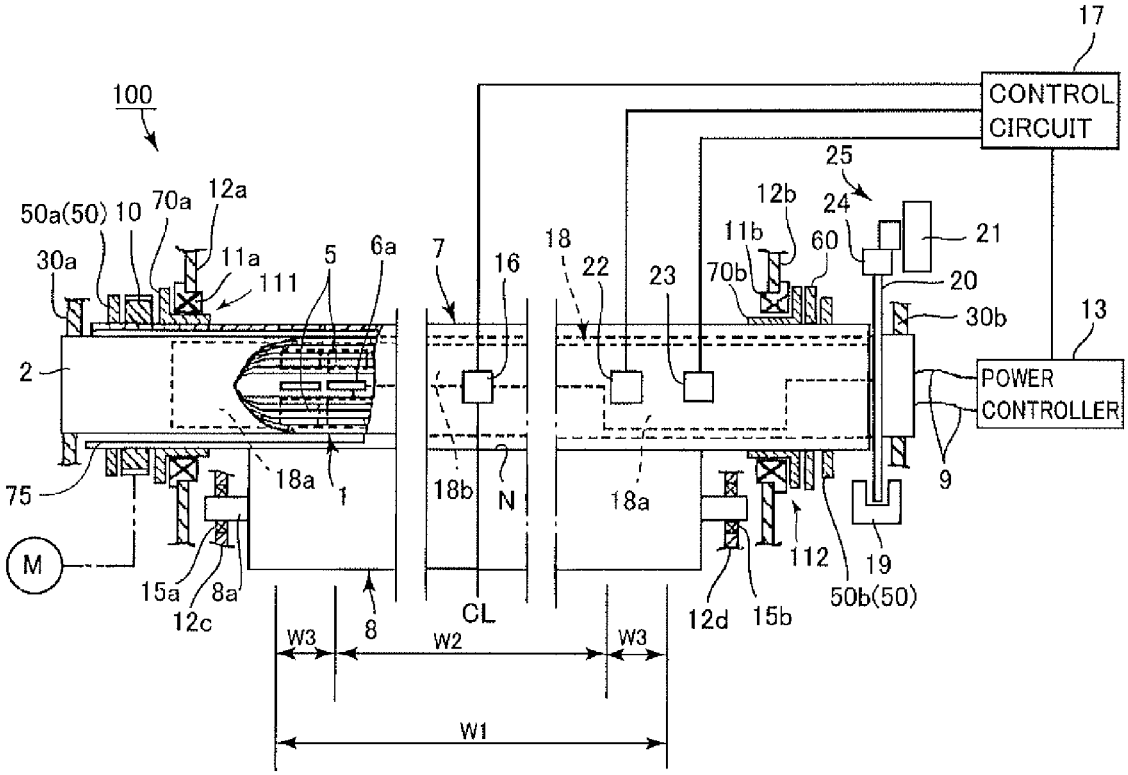
FIG. 3 is a schematic diagram illustrating a sectional configuration of the fixing apparatus taken in a direction in parallel with the axis thereof.

FIG. 2 is a schematic diagram illustrating a sectional configuration of the fixing apparatus 100 taken in a direction vertical to an axis thereof and FIG. 3 is a schematic diagram illustrating a sectional configuration of the fixing apparatus taken in a direction in parallel with the axis thereof.

As shown in FIG. 2, the heating assembly 1, i.e., an exemplary heating portion, is an inductive heating unit disposed within the fixing roller 7. The heating assembly 1 forms one unit replacement assembly by combining an exciting coil 5, first magnetic substance cores 6*a*, second magnetic substance cores 6*b* and others. The fixing roller 7 is inductively heated (joule heating or IH heating by eddy-current loss) by an action of magnetic fluxes generated from the heating assembly 1 as a high-frequency current is supplied to the exciting coil 5.

The fixing roller 7 is a thin hollow cylindrical roller that generates heat corresponding to electromagnetic induction and may be made of metal such as iron, nickel and cobalt. The fixing roller 7 is set around 0.3 to 2 mm in thickness to reduce a thermal capacity and is formed of the ferromagnetic (having large magnetic permeability) metallic material to input more the magnetic fluxes generated from the exciting coil 5 and guided by the cores 6*a* and 6*b* to the fixing roller 7. The heat is generated efficiently in the fixing roller 7 by generating the eddy current efficiently by enhancing magnetic flux density involved in the generation of heat. The fixing roller 7 is provided with a toner releasing layer 7*a* composed of 10 to 50 μm of polytetrafluoroethylene (PTFE) or 10 to 50 μm of tetrafluorethylene-perfluoro alkyl vinyl ether copolymer (PFA) of fluororesin in general on an outer surface thereof. It is also possible to provide a rubber layer as an elastic layer to the fixing roller 7 so that the toner releasing layer is coated around the rubber layer.

A pressure roller 8 is an elastic roller arrayed below in parallel with the fixing roller 7 and rotates in a direction of an arrow B in FIG. 2, following the rotation of the fixing roller 7 in a direction of an arrow A. The pressure roller 8 includes an iron-made core grid 8*a*, a silicon rubber layer 8*b* provided as an elastic layer around the core grid 8*a* and a toner releasing layer 8*c* provided around the elastic layer.

In operation, the fixing roller 7 rotates and the pressure roller 8 follows the rotation of the fixing roller 7 in a state in which the fixing roller 7 is inductively heated as power is supplied to the exciting coil 5 of the heating assembly 1 and temperature of the fixing roller 7 is controlled to a predetermined fixing temperature. At this time, a recording member S carrying a non-fixed toner image (t) transferred in the secondary transfer portion T2 of the image forming apparatus 200 shown in FIG. 1 is led into the heating nip portion N of the fixing apparatus 100 from a direction of an arrow C on a recording member conveying path H. The non-fixed toner image (t) on the surface of the recording member S is fixed on the surface of the recording member S by the heat and nipping pressure of the fixing roller 7 in a process of being nipped and conveyed through the heating nip portion N. That is, the toner image is fixed on the recording member S through processes of melting the non-fixed toner image carried on the recording member S by thermal energy applied from the fixing roller 7 and of pressing such molten toner by contact pressure of the pressure roller 8 so as to infiltrate between fibers of the recording member S. A separating claw 14 prevents the recording member S that has passed through the heating nip portion N from winding around the fixing roller 7 by mechanically separating the recording member S from the fixing roller 7.

The heating assembly 1 has a non-rotable stay 3 that penetrates through the fixing roller 7 in a longitudinal direction thereof and a holder 2 supported by the stay 3. The holder 2 accommodates the exciting coil 5 and the magnetic substance cores 6*a* and 6*b*. The holder 2 is formed of heat-resistant resin substantially into a semi-cylindrical shape and disposed within the fixing roller 7 contactlessly from an inner surface 75 of the fixing roller 7 by assuring a predetermined gap with an angle-attitude of orienting a semi-cylindrical surface thereof to the side from which the recording member is introduced. The holder 2 is a non-magnetic molded member in which glass is doped to a polyphenylene sulfied (PPS) based resin having both heat resistance and mechanical strength. The non-magnetic material suited for the holder 2 are the PPS-based resin, polyetherether ether ketone (PEEK) based resin, polyimide resin, polyamide-based resin, polyamide-imide-based resin, ceramics, liquid crystal polymer, fluorine-based resin and the like.

The holder 2 holds the plurality of first magnetic substance cores 6*a* disposed at the center thereof along a longitudinal direction the holder 2. The holder 2 also holds the pluralities of sets of second magnetic substance cores 6*b* disposed so as to sandwich the first magnetic substance cores 6*a*. The first and second magnetic substance cores 6*a* and 6*b* are disposed to improve efficiency of a magnetic circuit and to shield magnetism. It is preferable to use high permeable and low-loss magnetic substances for the first and second magnetic substance cores 6*a* and 6*b*, such magnetic material of a core of a transformer as ferrite and permalloy may be used.

The exciting coil 5 is wound centering on the magnetic substance cores 6*a*. In order to generate alternating fluxes fully for heating, a resistant component of the exciting coil 5 has to be low and an inductance component has to be high. A coil wire rod of the exciting coil 5 is a litz wire composed of 140 wires, each having 0.17 mm in outer diameter, and having a total outer diameter of 4 mm. By considering a case when temperature of the exciting coil 5 rises, a heat-resistant material is used for insulating coating of the litz wire. It is possible to render the magnetic fluxes generated from the exciting coil 5 to pass more through an exothermic layer of the fixing roller 7 and to enhance exothermic efficiency of the fixing roller 7 by disposing the first and second magnetic substance cores 6*a* and 6*b* in the vicinity of an inner circumferential surface 75 of the fixing roller 7.

A holder lid 4 is substantially semi-cylindrical and is fitted to the holder 2 in which the first and second magnetic substance cores 6*a* and 6*b* and the exciting coil 5 are disposed. The holder lid 4 is made of the same material with that of the holder 2. The first and second magnetic substance cores 6*a* and 6*b* and the exciting coil 5 are pressed and held between the holder 2 and the holder lid 4.

As shown in FIG. 3, both end portions of the holder 2 are non-rotably supported by holder supporting plates 30*a* and 30*b* provided on the outsides of side plates 12*a* and 12*b* of the fixing apparatus 100. The fixing roller 7, i.e., a cylindrical tube, is rotably held between the right and left side plates 12*a* and 12*b* through heat-insulating bushings 70*a* and 70*b* and bearings 11*a* and 11*b*. The fixing roller 7 is driven and rotated with predetermined circumferential speed by a roller gear 10, fixed at one end portion, to which turning force is transmitted from a driving mechanism M.

The core grid 8*a* of the pressure roller 8 is rotably held by bearings 15*a* and 15*b* provided in frames 12*c* and 12*d* which support the pressure roller 8. The frames 12*c* and 12*d* are arranged so that the pressure roller 8 press-contacts an under surface of the fixing roller 7 with a predetermined pressure by a biasing mechanism (pressure springs) not shown to form the heating nip portion N having a predetermined length in the conveying direction.

A temperature-controlling thermister 16 is disposed so as to face to the fixing roller 7 substantially at a longitudinally center region of the roller 7. A control circuit 17 controls temperature of the fixing roller 7 to be a predetermined fixing temperature (target temperature) based on a detection signal of the thermister 16. That is, the control circuit 17 controls power supplied to the exciting coil 5 by a power controller (exciting circuit) 13 according to a temperature control program so that surface temperature of the fixing roller 7 is kept at the predetermined temperature.

The recording member S is conveyed and fed to the fixing apparatus 100 so that a center of the recording member S is aligned with a sheet passing center line CL as shown in FIG. 3. A passable maximum sheet width W1 of the fixing apparatus 100 is a transverse feed width (297 mm) of an A4 sheet and a smaller sheet width W2 is a longitudinal feed width (210 mm) of the A4 sheet. Since the maximum sheet width W1 is a normal sheet width, the normal sheet width will be denoted as W1 hereinafter.

A length in which the first magnetic substance cores 6*a* are disposed along the longitudinal direction of the holder 2 is substantially equal to the normal sheet width W1 and positionally corresponds to the transverse feed width of the A4 sheet. A length in which the second magnetic substance cores 6*b* are disposed is also substantially equal to the normal sheet width W1 and positionally corresponds to the transverse feed width of the A4 sheet.

Non-sheet passing regions W3 on the both ends of the fixing roller 7 are parts produced in the heating nip portion N when a recording member S of the smaller sheet width W2 is fed. That is, each non-sheet passing region W3 is an area caused by a difference between the maximum sheet width W1 and the smaller sheet width W2. A shutter thermister 22 is disposed so as to face to the non-sheet passing region W3 of the fixing roller 7 and a shutter thermister 23 is disposed so as to face to the outer circumferential surface of the fixing roller 7 on the outside of the non-sheet passing region W3.

The control circuit 17 determines the target temperature of the fixing roller 7 based on detected results of the shutter thermisters 22 and 23. When the temperature detected by the shutter thermisters 22 and 23 exceed an allowable range, the control circuit 17 moves a shielding member 18 disposed in a gap between the heating assembly 1 and the fixing roller 7 to shield the magnetic fluxes.

<Magnetic Flux Shielding Member>

Figure 4A:
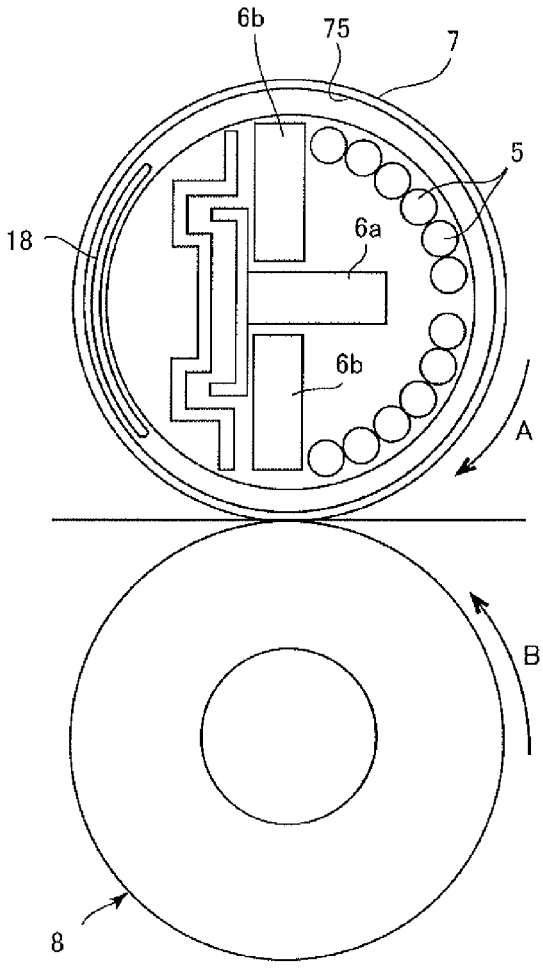
FIG. 4A is a schematic diagram illustrating a withdrawn position of a shielding member.
Figure 4B:
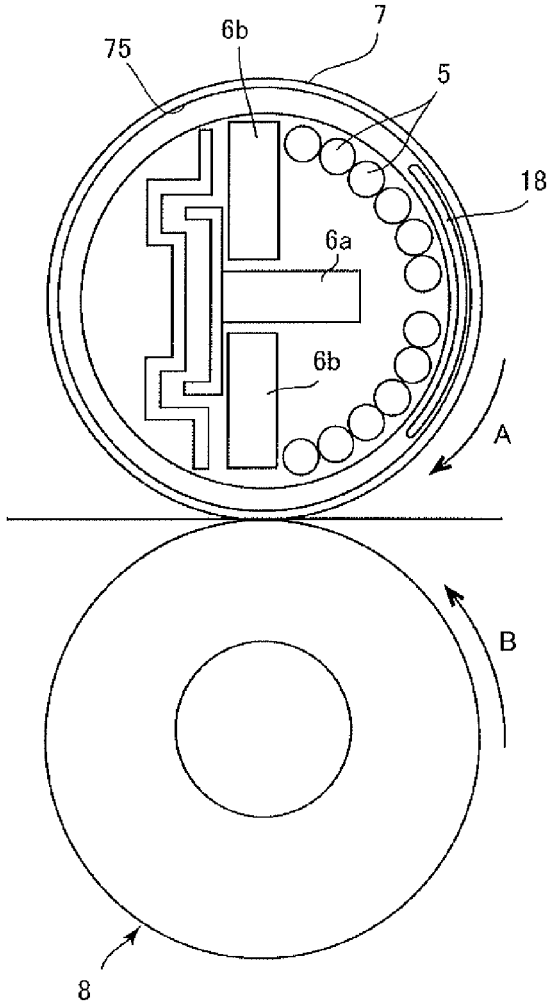
FIG. 4B is a schematic diagram illustrating a flux shielding position of the shielding member.

FIGS. 4A and 4B are schematic diagrams explaining operations of the shielding member 18. The shielding member 18 is a shutter that shields a part of the fluxes acting from the exciting coil 5 to the fixing roller 7 as illustrated in FIG. 3 and a shielding portions 18*a* (see FIG. 3) ease an overheat of the non-sheet passing regions W3 on the both ends of the fixing rocker 7 by shielding the alternating fluxes.

A driving motor 21 (see FIG. 3) moves the shielding member 18 by turning a driving gear 20 through an intermediary of a gear train 24. The shielding member 18 is attached to the driving gear 20 by one end thereof and moves in the circumferential direction as the driving gear 20 rotates. The driving gear 20 is provided with position detecting slits not shown at two places of a shielding position (position shown in FIG. 4B) of shielding the flux and at a withdrawn position (position shown in FIG. 4A) of not shielding the flux. A gear position sensor 19 detects the position of the shielding member 18.

A material suitable for the shielding member 18 is a non-magnetic material which is a conductor that flow an induced current and whose specific resistance is small, such as copper, aluminum, silver and an alloy thereof or ferrite whose material resistance is large and the like. Such magnetic materials as iron and nickel can be used by suppressing generation of heat otherwise caused by eddy current by forming through-holes such as circular holes and slits. As indicated by a dotted line in FIG. 3, the shape of the shielding member 18 is changed in a direction orthogonal to the direction in which the recording member S is conveyed i.e., the longitudinal direction of the fixing roller 7, so that the both end portions thereof connected and supported by a supporting portion 18*b* extend like a projection in the circumferential direction of the fixing roller 7 as the shielding portions 18*a*.

The control circuit 17 (see FIG. 3) drives and rotates the driving motor 21 based on a position signal of the shielding member 18 detected by a gear position sensor 19 and a size detecting signal detected by a size detecting sensor not shown that detects the size of the recording member S fed to the heating nip portion N. The control circuit 17 determines a longitudinal width and position of the shielding portion 18*a* corresponding to the size of the recording member presumed to be necessary to shield the flux and moves the shielding member 18 in the circumferential direction along the inner circumferential surface 75 of the fixing roller 7. That is, the control circuit 17 turns and move the shielding member 18 from the withdrawn position (home position shown in FIG. 4A) to the shielding position (position shown in FIG. 4B) or from the shielding position to the withdrawn position.

As shown in FIG. 4A, the shielding member 18 is held at the withdrawn position on the side opposite from the exciting coil 5 of the heating assembly 1 within the fixing roller 7 in fixing an image with the maximum sheet width W1. The withdrawn position is a position where no flux acts substantially on the fixing roller 7 from the heating assembly 1. When the shielding member 18 is located at the withdrawn position, the alternating fluxes inputted to the fixing roller 7 by being guided by the first and second magnetic substance cores 6*a* and 6*b* inductively heat the whole area in the longitudinal direction of the fixing roller 7 without being shielded in the whole area in the longitudinal direction.

When an image is fixed with the smaller sheet width W2, the shielding member 18 is held at the shielding position on the side of the exciting coil 5 of the heating assembly 1 within the fixing roller 7 as shown in FIG. 4B. In the shielding position, the shielding portion 18*a* shields a part of the fluxes acting on the fixing roller 7 from the heating assembly 1 at the non-sheet passing region W3. Thus, it is possible to prevent temperature of the non-sheet passing region W3 of the fixing roller 7 from excessively rising when small-size recording members are conveyed successively by forming the shielding member 18 into the shape of shielding the non-sheet passing region W3 of the fixing roller 7 corresponding to the small-size recording members. When the shielding member 18 is located at the shielding position, the part of the alternating fluxes heading the fixing roller 7 in the end portions in the longitudinal direction is shielded by the shielding portion 18*a* of the shielding member 18, so that the non-sheet passing region W3 of the fixing roller 7 is suppressed from generating heat.

It is noted that the mechanism for suppressing the excessive temperature rise of the both non-sheet passing regions W3 is not limited to be the shielding member 18. It is also possible to change the passage of fluxes from the exciting coil 5 to the fixing roller 7 and to control a distribution of magnetic flux density in the longitudinal direction of the fixing roller 7 by relatively movably disposing the magnetic substance cores 6*a* with respect to the exciting coil 5.

By the way, when the fixing roller 7 is thinned to reduce its thermal capacity and the induction heater 1 is disposed in close proximity with the inner circumferential surface 75 of the fixing roller 7 in order to save power and to shorten a start-up time in the electromagnetic induction heating system, there is seen a tendency of drop of the capability of clamping the fixing roller 7 of the prior art retaining ring 50E. Therefore, there is a need for new measures for such configuration of the prior art retaining ring.

Figure 7A:
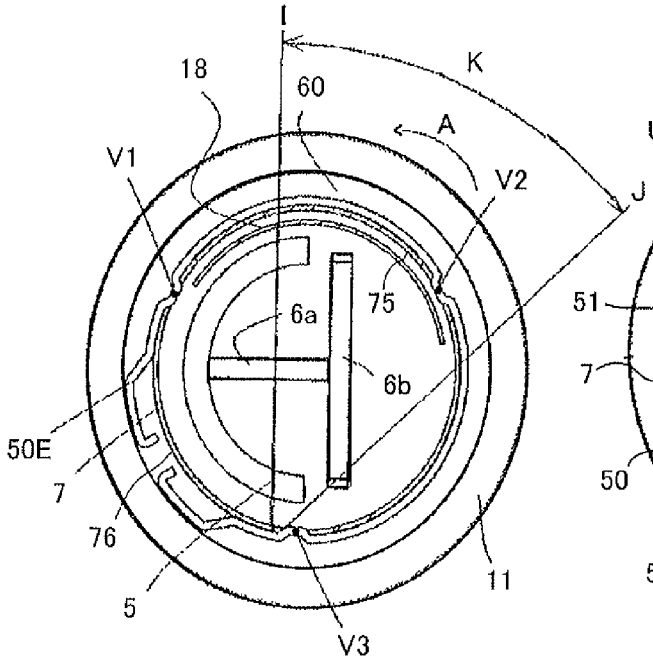
FIG.7A PRIOR ART
FIG. 7A is a diagram illustrating a prior art retaining ring.
Figure 7B:
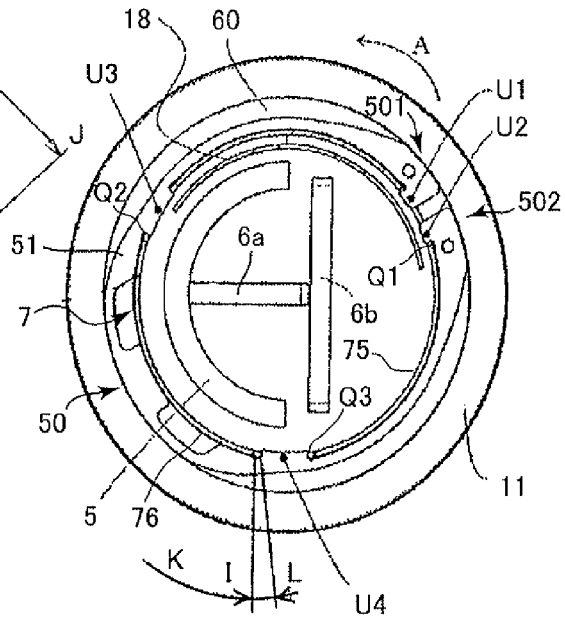
FIG. 7B is a diagram illustrating the retaining ring of the first embodiment.

Then, as shown in FIG. 7B, even though the heating assembly 1 and the shielding member 18 are disposed in the vicinity of the inner circumferential surface 75 of the roller 7, there is provided a retaining ring 50 capable of clamping the fixing roller 7 with enough strength while assuring a clearance between the retaining ring 50 and the heating assembly 1 or the shielding member 18 which is capable of controlling heating of the fixing roller 7. With this arrangement, it is possible to fabricate projections by a thickness of the thin fixing roller 7 and to assure the enough clearance even when there exists parts in the vicinity of the inner circumferential surface 75 of the fixing roller 7 without impairing the performance for clamping the fixing roller 7.

Figure 5A:
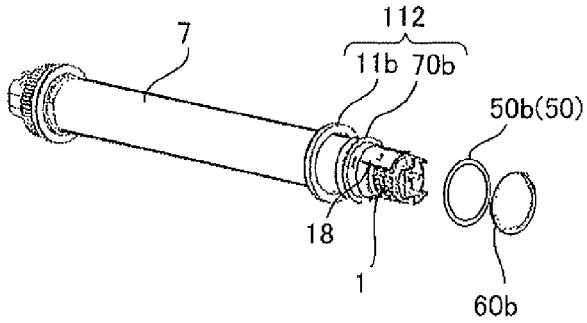
FIG. 5A is a perspective view showing a fixing roller of a first embodiment.
Figure 5B:
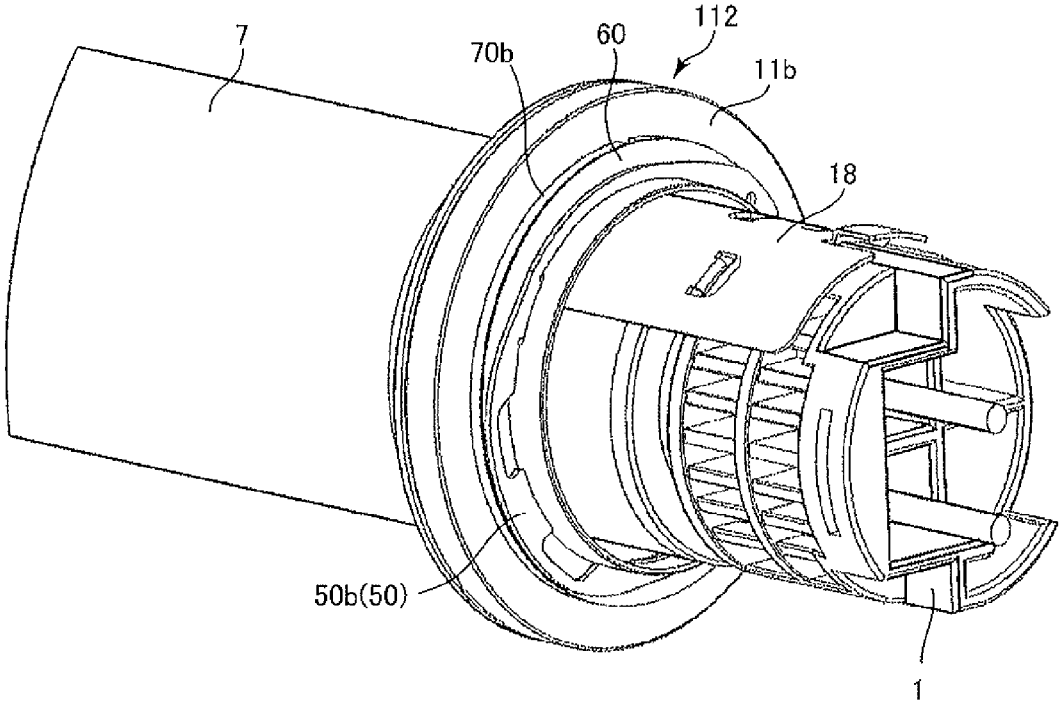
FIG. 5B is an enlarged view of an end portion of the fixing roller in FIG. 5A.
Figure 6:
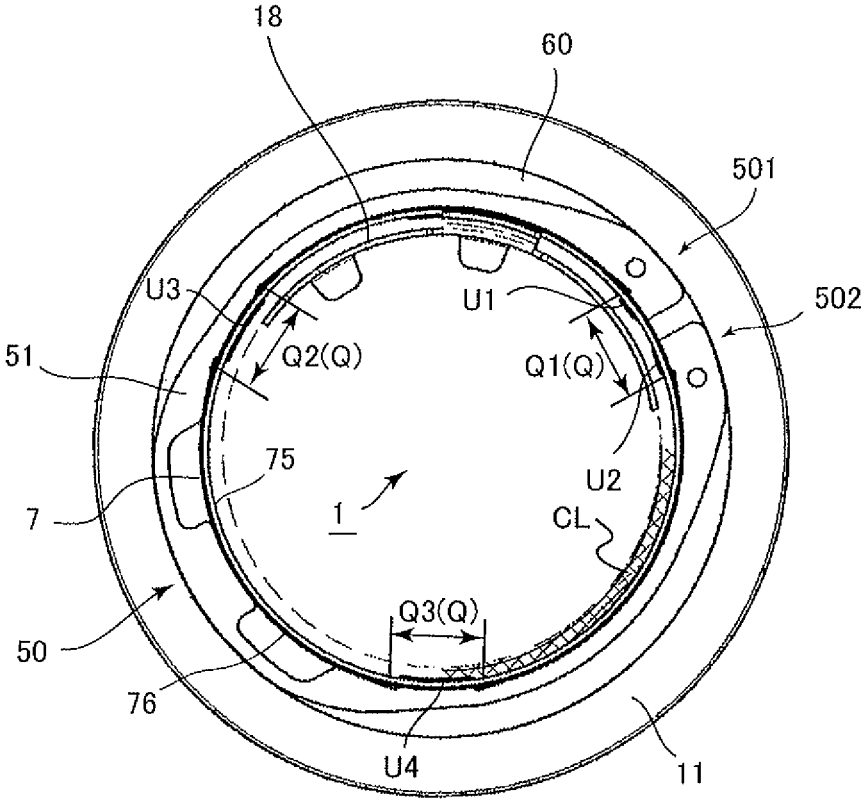
FIG. 6 is a diagram illustrating a state in which the retaining ring of the first embodiment is assembled to the fixing roller.

FIGS. 5A and 5B are perspective views of an assembled state of the fixing roller 7 of the first embodiment. FIG. 6 is a diagram illustrating a state in which the retaining ring 50 of the first embodiment is fixed to the fixing roller 7.

As shown in FIGS. 5A and 5B, the heating assembly 1, i.e., an exemplary inductive heating unit, can inductively heat the fixing roller 7, i.e., an exemplary roller, by inputting magnetic fluxes to the fixing roller 7. The shielding member 18 is a magnetic flux shielding member disposed so as to face to the inner circumferential surface 75 of the fixing roller 7 and is movable along the inner circumferential surface of end-side areas of the fixing roller 7.

As shown in FIG. 3, bearing portions 111 and 112 are assembled with the fixing apparatus 100 by using bearing mounting structures and are fitted around the end portion of the fixing roller 7 to rotably support the fixing roller 7. Each of the bearing portions 111 and 112 disposed in the both end of the fixing roller 7 is constructed by fitting the bearing 11*a* or 11*b* around the heat-insulating bushing 70*a* or 70*b*. The heat insulating bushings 70*a* and 70*b*, which are exemplary heat-insulating members, are fitted around the end portions of the fixing roller 7 to reduce a leakage of heat from the fixing roller 7. Bearings 11*a* and 11*b*, which are exemplary bearing members, are fitted around and rotably support the heat insulating bushings 70*a* and 70*b*. As shown in FIGS. 6 and 7B, the retaining ring 50 includes a body 51 formed into a shape of C. First and second end portions 501 and 502 of the body 51 are arranged so that a distance between them can be elastically changed. Then, the retaining ring 50 is fitted around the fixing roller 7 by hooking the first and second end portions 501 and 502 to one and same hole Q1 and by fitting projections U3 and U4 in a plurality of holes Q2 and Q3 formed around the fixing roller 7. The retaining ring 50 is fixed at a predetermined position in an axial direction of the fixing roller 7 to fasten the outer circumference of the fixing roller 7 by the C-shaped profile and to restrict the bearing portion from moving in the axial direction.

At one end portion of the fixing roller 7 shown in FIG. 5 for example, the retaining ring 50*b* is used to position the bearing portion 112 (111) axially on the fixing roller 7. A washer (spacer) is disposed between the heat-insulating bushing 70*b* and the retaining ring 50*b* to prevent wear of the heat-insulating bushing 70*b*. The plurality of holes Q1 through Q3 is formed in the circumferential direction of the fixing roller 7 and the retaining ring 50*b* is attached to the fixing roller 7 in a state in which the projections U1 through U4 of the retaining ring 50*b* are inserted into the holes Q1 through Q3. The retaining ring 50*b* restricts the moving of the bearing portion 112 in the axial direction to position the bearing portion 112 at the end portion of the fixing roller 7 by holding a side surface of the bearing portion 112. As shown also in FIG. 6, the four projections U1 through U4 of the retaining ring 50 are inserted respectively into the holes Q1 through Q3 of the fixing roller 7 located at one end portion of the fixing roller 7 extending to the outside in the axial direction from the bearing portion 112 (111). Thus, the retaining ring 50 is supported in the axial direction at the three points around the outer circumferential surface 76 of the fixing roller 7. Because the retaining rings 50*a* and 50*b* shown in FIG. 3 are identical members, they will be explained as the retaining ring 50 all together hereinafter.

As shown in FIG. 6, the retaining ring 50 is a sheet-like member punching a final profile from a sheet metal material and is fitted around the roller 7 by inserting and anchoring the projections U1 through U4 of the retaining ring 50 into the plurality of holes Q1 through Q3 which are long in the circumferential direction and disposed around the end portion of the fixing roller 7. The retaining ring 50 (the body 51) surrounding the outer circumferential surface 76 of the fixing roller 7 is formed so that the opening between the first and second end portions 501 and 502 facing in the circumferential direction is openable. Beside the body 51 formed platelike, the retaining ring 50 includes the first projection U1 that projects inwardly from the first end portion 501 of the body 51 and that is fitted into the hole Q1 of the fixing roller 7 and the second projection U2 that projects inwardly from the second end portion 502 and that is also fitted into the hole Q1 of the roller 7. As shown in FIG. 9, a profile of side surfaces L1 of the first projection U1 of the first end portion 501 and a profile of side surfaces L2 of the second projection U2 of the second end portion 502 that contact with edge 72 of the hole Q1 as the retaining ring 50 moves in the circumferential direction are both recessed in the circumferential direction. This recess includes U-shaped and V-shaped recesses.

In order to save power and to shorten a start-up time of the fixing apparatus 100 using the electromagnetic induction heating system, the thickness of the fixing roller 7 of the first embodiment is reduced from 1.0 mm of the conventional roller to 0.65 mm to reduce a thermal capacity. Still further, as shown in FIG. 6, the clearance CL between the shielding member 18 and the inner circumferential surface of the fixing roller 7 is narrowed to 1.2 mm, as indicated by hatching, from 1.6 mm of the conventional one. The narrower the clearance, the more the magnetic fluxes of the exciting coil 5, the first and second magnetic substance cores 6*a* and 6*b* are captured by the metal layer of the fixing roller 7, thus improving heat-generating efficiency.

The fixing roller 7 is provided with three holes Q1 through Q3 which is thin and long in the circumferential direction (slits) for attaching the retaining ring 50 on the circumferential surface thereof. A flute length in the circumferential direction of each hole Q1 through Q3 is 8.0 mm and a flute width in the axial direction thereof is 1.2 mm. The retaining ring 50 is attached to the fixing roller 7 while inserting the projections U1 through U4 into the three holes Q1 through Q3 as described above. Because the projections U1 through U4 are designed so that a length of the projections from an outer circumferential surface 76 of the fixing roller 7 is 1 mm, a length projecting out of the inner circumferential surface 75 of the fixing roller 7, deducting the thickness of the fixing roller 7 of 0.65 mm, is 0.35 mm. Thereby, 0.85 mm obtained by deducting the projecting length of 0.35 mm from the clearance CL=1.2 mm is assured as the clearance between the rotatable shielding member 18 and the projections U1 through U4.

The retaining ring 50 is finished to the final profile by punching a thin plate of stainless steel spring material of 0.8 mm in thickness by a press mold in the first embodiment. When a small number of retaining rings is to be produced, they may be formed by cutting out the final profile from a thin plate by laser machining. That is, the body 51 and the projections U1 through U4 are formed platelike in a body.

The retaining ring 50 is formed so as to have the opening and so that the pair of projections U1 and U2 face at the opening to assure strength of the punching mold at the opening part and to render the retaining ring to adhere to the outer circumferential surface 76 of the fixing roller 7 by assuring a room to elastically deform to the inside. Although it is possible to render the retaining ring 50 to be a closed-shape by a post-process (baking and the like), it is not desirable in view of metal fatigue because the plate is plastically deformed.

<Comparison with Prior Art Retaining Ring>

Figure 8A:
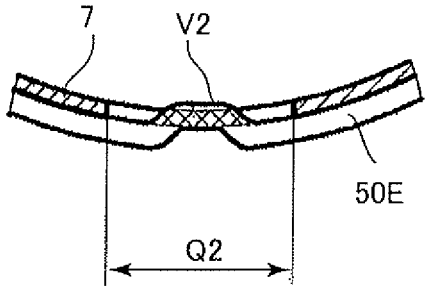
FIG.8A PRIOR ART
FIG. 8A is a diagram illustrating a shape of a projection of the prior art retaining ring.
Figure 8B:
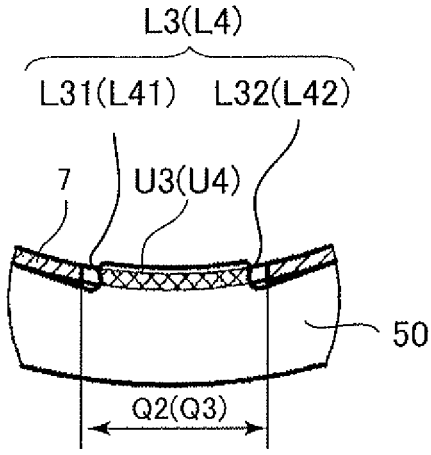
FIG. 8B is a diagram illustrating a shape of a projection of the retaining ring of the first embodiment.
Figure 9A:
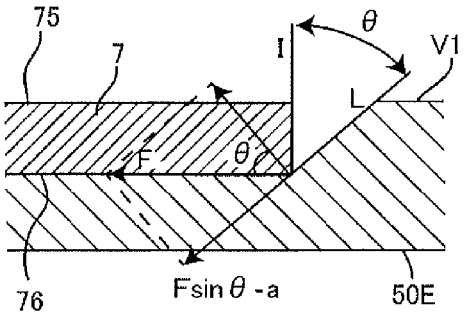
FIG.9A PRIOR ART
FIG. 9A is a diagram illustrating a contact pressure of the projection of the prior art retaining ring.
Figure 9B:
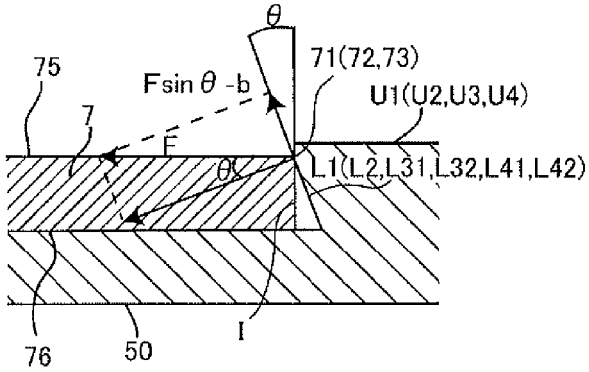
FIG. 9B is a diagram illustrating a contact pressure of the projection of the first embodiment.
Figure 10:
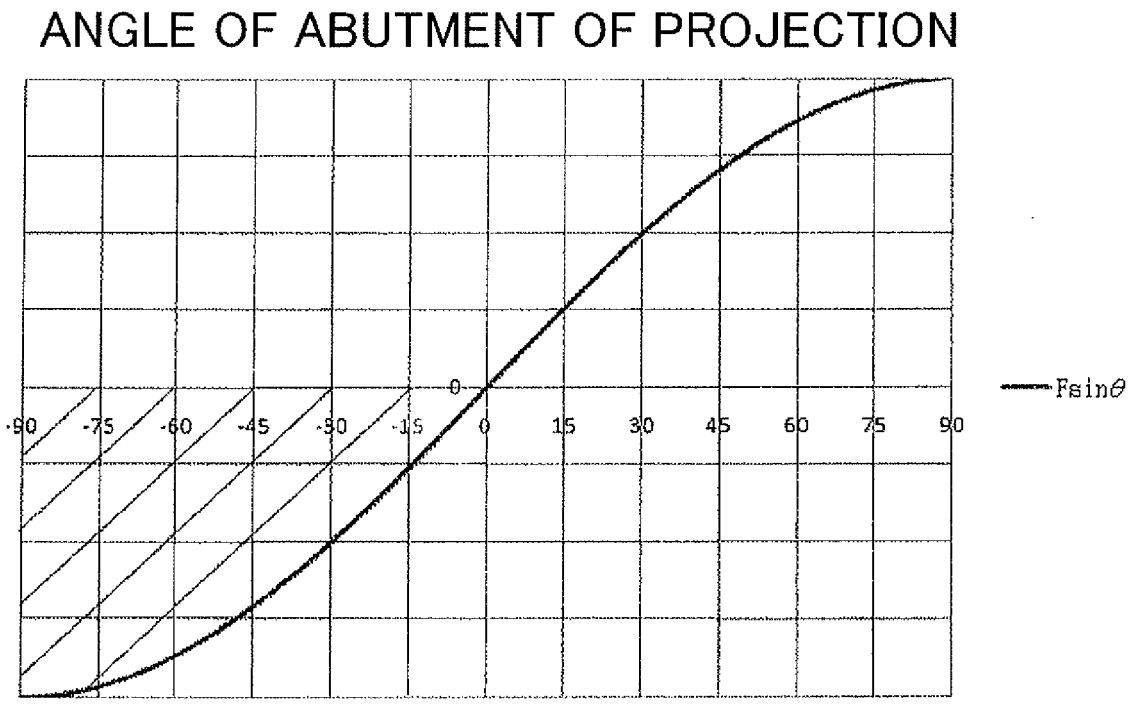
FIG. 10 is a graph explaining an inclination angle of the projection.

FIGS. 7A and 7B are diagrams comparatively explaining performances of the prior art retaining ring and of the retaining ring of the first embodiment. FIGS. 8A and 8B are diagrams comparatively explaining the shapes of the projections of the prior art retaining ring and of the retaining ring of the first embodiment. FIGS. 9A and 9B are diagrams comparatively explaining contact pressures of the projections of the prior art retaining ring and of the retaining ring of the first embodiment. FIG. 10 is a graph explaining an inclination angle of the projection. FIGS. 7A, 8A and 9A show the prior art retaining ring and FIGS. 7B, 8B and 9B show the retaining ring of the first embodiment. It is noted that in FIGS. 7 through 9, the retaining rings formed of a square coil of the prior art and formed of the pressed member of the first embodiment are shown to have the same relationship in terms of a level of projection from the inner face (inner circumferential surface) of the fixing roller for comparison.

Among the two kinds of retaining rings disclosed in Japanese Patent Application Laid-open No. 2007-57644, the retaining ring whose projection projects largely to the inside of the roller cannot be adopted because the projection interferes the heating member. The other retaining ring in the disclosure has a possibility of floating up from the hole and running idle if a component force is generated in response to a relative movement in the circumferential direction of the retaining ring and the roller because the projection has a profile that generates the component force in a direction of pushing the projection out of the hole when the projection abuts an edge of an end portion of the hole.

As shown in FIG. 7A, the prior art retaining ring 50E formed by bending a square coil has been used conventionally to hold a side surface of a bearing portion 112 in the axial direction almost similarly to Japanese Patent Application Laid-open No. 2007-57644. The prior art retaining ring 50E of the square coil has been fabricated from 1 mm of square coil by a wire forming method.

A center projection V2 is formed into a shape of V so that its edge enters the inner diameter side of the fixing roller 7. Thereby, the prior art retaining ring 50E interferes with the side surface of a spacer 60 and prevents the fixing roller 7 from being uncoupled from the bearing 11. Here, the prior art retaining ring 50E may hardly trip from the fixing roller 7 if the projection V2 is heightened so that it projects largely from the inner circumferential surface 75 of the fixing roller 7. In this case, however, it is unable to move the shielding member 18 that is close to the inner circumferential surface 75 of the fixing roller 7 because no clearance is assured inside.

Still more, because the retaining ring 50E is arranged to fasten the fixing roller 7, the retaining ring 50E is required to have a quality of spring. While the retaining ring 50E is fabricated by means of the wire forming, the projections V1, V2 and V3 must be fabricated to have the V-shaped profile in terms of the clearance between the fixing roller 7 and the shielding member 18.

Here, if there is a deviation in an axial alignment of the fixing roller 7 and the pressure roller 8 shown in FIG. 3, a thrust force (a force in the axial direction) is generated in the fixing roller 7 because frictional force receiving from the pressure roller 8 varies in the axial direction. Then, because the bearings 11*a* and 11*b* are fixed on the side plates 12*a* and 12*b* of the fixing apparatus 100, the thrust force described above is applied also to the heat-insulating bushings 70*b*, the spacer 60 and the retaining ring 50 (50E). Thus, the retaining ring 50 (50E) receives this thrust force finally. This thrust force generates on the heat-insulating bushing 70*b*, the spacer 60 and the retaining ring 50 (50E) even in a state in which the rollers 7 and 8 are not in operation. If the rollers 7 and 8 are driven again from the non-operative state during which the thrust force is applied as described above, there is a possibility that the heat-insulating bushing 70*b* and the spacer 60 run idle and rotate relatively with the retaining ring 50 (50E). Then, a force (brake) in a direction of tearing off the retaining ring 50 (50E) is generated in the retaining ring 50 (50E) that normally turns together with the fixing roller 7. When the projection V2 (V1, V3) is the V-shaped as shown in the prior art retaining ring 50E of FIG. 8A at this time, the projection V2 (V1, V3) is less engaged with the hole Q2 (Q1, Q3) of the fixing roller 7. Then, because they are less engaged, when the axial alignment of the fixing roller 7 and the pressure roller 8 is imbalanced and the thrust force is generated on the fixing roller 7, there is a possibility that the opening of the prior art retaining ring 50E is opened and the whole parts are disengaged. A shearing force applied to a caching portion of the projections V1, V2 and V3 of the prior art retaining ring 50E which is formed by the square coil on starting the fixing apparatus 100 has been about 40 N/mm$^2$.

In the study of the prior art retaining ring 50E, the thrust force applied to the retaining ring when the axial alignment deviates by about 0.5° has been about 294 N. At a moment of driving the fixing apparatus 100, about 5 N of the force (brake) in the direction of tearing off the retaining ring is applied to the prior art retaining ring 50E due to a coefficient of static friction with the spacer 60 in the state in which the thrust force of about 294 N is applied. However, a bearing force against opening the prior art retaining ring 50E is about 1.8 N, there is a possibility that the opening of the prior art retaining ring 50E is opened and the whole parts of the prior art retaining ring 50E are disengaged.

As shown in FIG. 9A, the V-shaped projection V1 (V2, V3) is liable to override the fixing roller 7 in the circumferential direction because it inclined a side surface (caching portion) L of the projection V1 (V2, V3) by an angle which an outward force F sin θ-a is applied on the side surface L of the projection V1 with respect to the turning direction of the end surface I of the fixing roller 7.

In contrast, as shown in FIG. 6, the retaining ring 50 of the first embodiment is attached to the fixing roller 7 while inserting the four projections U1 through U4 into the holes Q1 through Q3. The holes Q1 through Q3 are formed with an equal length at angular positions per 120 degrees of the fixing roller 7, so that the projections U1 through U4 of the retaining ring 50 can be attached at any three angular positions and hence the retaining ring 50 can be attached to the fixing roller 7 at any angular positions of the three holes Q1 through Q3. That is, the first hole Q1 into which the first and second projections U1 and U2 are fitted, the second hole Q2 into which the third projection U3 is fitted and the third hole Q3 in which the fourth projection U4 is fitted may be any holes of these three holes Q. Still further, the second hole Q2 described above is formed at the position separated by 120 degrees in the circumferential direction from the first hole Q1 and the third hole Q3 is formed at the position separated by 120 degrees in the circumferential direction from the second hole Q2. That is, besides the first and second projections U1 and U2 described, the retaining ring 50 includes the set of projections U3 and U4 corresponding to the two angular positions separated per 120 degrees of the fixing roller 7. That is, the retaining ring 50 includes the third projection U3 projecting from the body 51 inwardly between the first and second projections U1 and U2 and fitted into the second hole Q2, and the fourth projection U4 projecting from the body 51 inwardly between the first and second projections U1 and U2 and fitted into the third hole Q3. More specifically, the third projection U3 projects inwardly at the position of the body 51 shifted from the first projection U1 in the circumferential direction by 120 degrees and the fourth projection U4 projects inwardly at the position of the body 51 shifted from the third projection U3 in the circumferential direction by 120 degrees. Accordingly, the retaining ring 50 is supported to the fixing roller 7 at the three points in the axial direction by inserting the pair of projections U1 and U2 into at any one hole Q (Q1) and by inserting the projections U3 and U4 into the remaining holes Q (Q2 and Q3). It is noted that a section in the thickness direction of the holes Q (Q1 through Q3) is cut so as to be substantially right-angled in the first embodiment.

In an experimental study of the fixing apparatus 100 of the first embodiment, a force (brake) in the direction of tearing off the retaining ring of about 7 N is applied to the retaining ring 50 by the coefficient of static friction with the spacer 60 at the moment of driving the fixing apparatus 100 in the condition in which the thrust force of about 294 N is applied. However, a tearing-off bearing force of the retaining ring 50 is 60 N or more. Therefore, the retaining ring 50 can lock the fixing roller 7 in the circumferential direction without opening the opening of the retaining ring 50 and can improve the bearing force in the axial direction as compared to the prior art retaining ring 50E.

As a result of increasing a caching area of the projection to the hole Q by about 1.7 times of the prior art projection, a shearing force applied to the caching portion of the projections U1 through U4 is reduced to about 25 N/mm$^2$ (see FIGS. 8B and 9B).

As shown in 9B, a part of the side surface L1 of the projection U1 that abuts an edge 71 of the hole Q1 in the circumferential direction is inclined at such an angle that generates an inward reaction force in the projection U1 in response to the part of projection U1 abutting the edge 71 of the hole Q1 in the circumferential direction. A part of the side surface L2 of the projection U2 that abuts edge 71 of the hole Q1 on the side opposite from the projection U1 in the circumferential direction is inclined at such an angle that generates an inward reaction force in the projection U2 in response to the part of the projection U2 abutting the edge 71 of the hole Q1 in the circumferential direction. Still further, parts of side surfaces L31, L32, L41 and L42 of the third and fourth projections U3 and U4 that abut respectively edges 72 and of the hole Q2 and Q3 in the circumferential direction are inclined at such an angle that generates an inward reaction force in the projections U3 and U4 in response to the parts of the projections U3 and U4 abutting the edges 72 and 73 of the holes Q2 and Q3 in the circumferential direction.

That is, as shown in FIG. 9B, a part of the side surface L1, L2, L3 and L4 of each of the first through fourth projections U1 through U4 that possibly abuts the edges 71 through 73 of the holes Q1 through Q3 in the circumferential direction is inclined in the circumferential direction so that a frontend thereof comes closer to the end surface I of the holes Q1 through Q3. Therefore, when the fixing roller 7 and the retaining ring 50 rotate relatively in the circumferential direction, the at least one side surface L1 or L2 (L3 and L4) of projections U1 through U4 abuts the inner end portion 71 (72 and 73) where the inner circumferential surface 75 of the fixing roller 7 intersects with the end surface I of the hole Q1 (Q2 and Q3). Then, due to the inclination of the side surface L1 or L2 (L3 and L4) of the projections U1 through U4, a reaction force is generated toward the inside of the fixing roller 7 and the projection U1 or U2 (U3 and U4) try to move inwardly in the radial direction of the retaining ring 50 along the inclination. Due to that, the retaining ring 50 exerts a force in a direction of fastening the fixing roller 7 as a whole and the retaining ring 50 bites into the fixing roller 7.

In other words, the side surfaces L1 through L4 of the projections U1 through U4 are formed into the shape of biting into the fixing roller 7 in the circumferential direction (a shape of a wedge) by inclining at an angle by which an inward force F sin θ-b is applied to the side surfaces L1 through L4 of the projections U1 through U4 with respect to the turning direction of the end surface I of the holes Q1 through Q3 of the fixing roller 7. With this arrangement, the opening of the retaining ring 50 is not opened, so that it is not necessary to fabricate the retaining ring 50 into the closed shape.

An angle of abutment θ of the part of side surface (wedge) and the hole Q is set at 7°. It is possible to obtain an effect of the wedge when the angle of abutment θ, i.e., the inclination angle of the side surface of the projection U1 (U2, U3, U4), is set within a slanted area in a graph in FIG. 10. That is, when a direction separating from the end surface I of the hole Q in the circumferential direction with respect to a vertical plane is defined as a plus direction and a direction approaching to the end surface I as a minus direction, it is preferable to set the angle of abutment θ within a range of $0° < \theta \leq -90°$.

Second Embodiment

Figure 11:
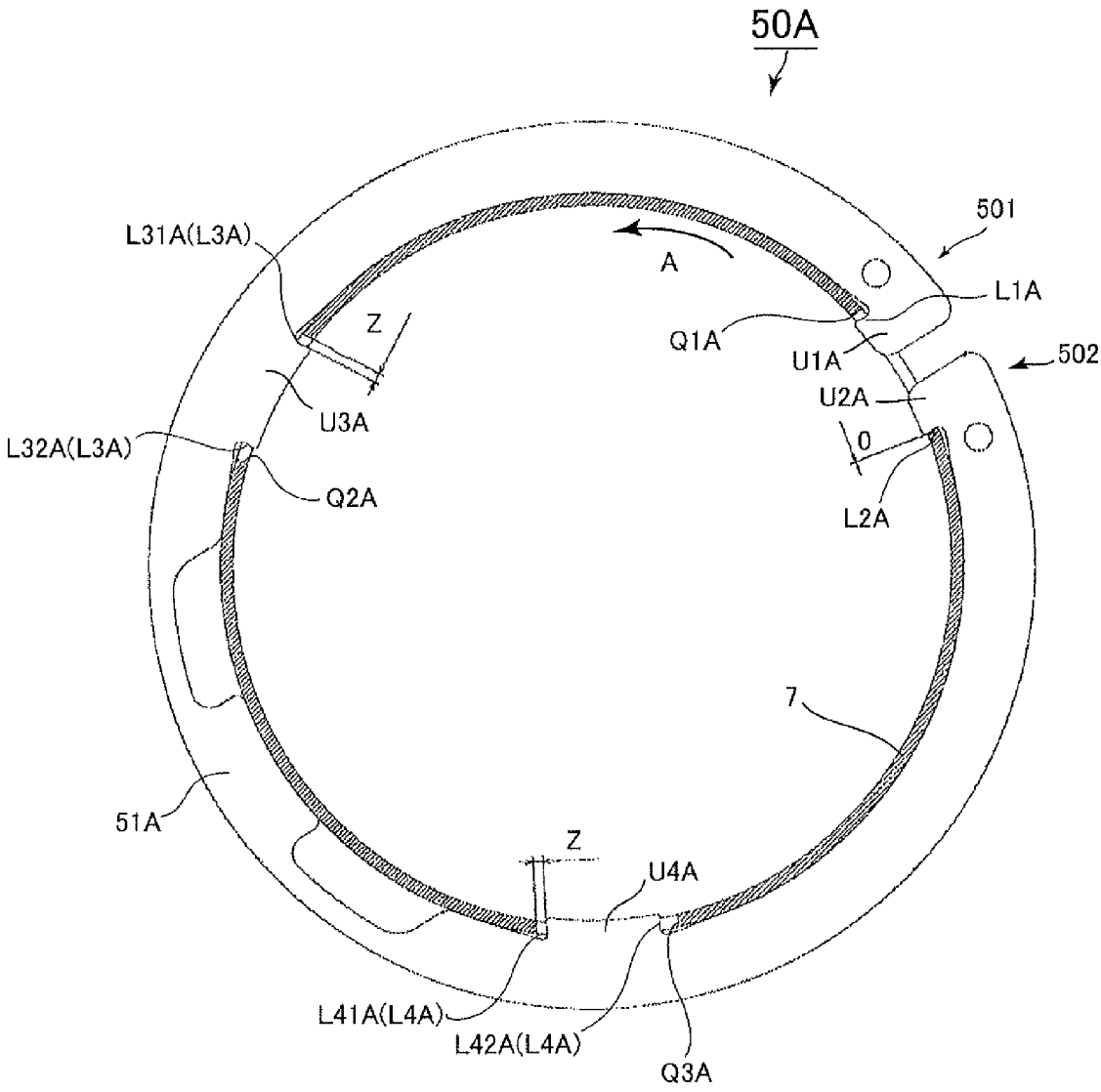
FIG. 11 is a plan view of a retaining ring of a second embodiment.

FIG. 11 is a plan view of a retaining ring 50A of a second embodiment. As shown in FIG. 11, the retaining ring 50A has a first end portion 501 formed at one end in the circumferential direction of a platelike body 50A thereof formed into a shape of C and a second end portion 502 formed at another end of the first end portion 501. These first and second end portions 501 and 502 have first and second projections U1A and U2A fitted into a hole (first hole) Q1A. Profiles of parts of a side surfaces L1A and L2A of these first and second projections U1A and U2A abutting edges of the hole Q1A as the retaining ring 50A moves in the circumferential direction are both recessed in the circumferential direction.

The retaining ring 50A also has third and fourth projections U3A and U4A that project inwardly at intermediate positions (positions between the first and second end portions 501 and 502) in the circumferential direction of the C-shaped body 51A. Profiles of both side surfaces L31A, L32A, L41A and L42A of the projections U3A and U4A are both recessed in the circumferential direction. The retaining ring 50A designed profiles and lengths of first through forth projections U1A through U4A so that the third and fourth projections U3A and U4A inserted into the second and third holes Q2A and Q3A do not abut edges of the second and third holes Q2A and Q3A respectively in the circumferential direction in a range in which the first and second projections U1A and U2A move within the first hole Q1A.

When the fixing roller 7 and the retaining ring 50A rotate while contacting a side surface L2A of the projection U2A with an end surface of the hole Q1A of the fixing roller 7, gaps Z are produced between side surfaces L3A and L4A of the other projections U3A and U4A of the retaining ring 50A and end surfaces of the holes Q2A and Q3A.

The projection U1A facing to the projection U2A also has the similar relationship with the projections U3A and U4A. That is, when the fixing roller 7 and the retaining ring 50A rotate while contacting a side surface L1A of the projection U1A with an end surface of the hole Q1A of the fixing roller 7, gaps Z are produced between side surfaces L3A and L4A of the other projections U3A and U4A of the retaining ring 50A and end surfaces of the holes Q2A and Q3A. A circumferential length of the projections U1A through U4A and a circumferential length and disposition of the holes Q1A through Q3A are designed as described above.

As a result, the projection U1A or U2A located at the end portions of the retaining ring 50A abuts the end surface of the hole Q1A and hampers the side surfaces of the other projections U2A and U3A from abutting the end surfaces of the holes Q2A and Q3A when the retaining ring 50A turns relatively with the fixing roller 7 in either directions in the circumferential direction. With this arrangement, a force in a direction of closing the opening of the retaining ring 50A and fastening the retaining ring 50A onto the fixing roller 7 acts on the retaining ring 50A in either case, thus preventing the opening from opening.

In contrast, when the prior art retaining ring 50E shown in FIG. 7A turns while contacting the side surface of the projection V2 with the end surface of the hole Q2, a force of opening the both ends of the retaining ring 50E acts centering on the contact part. Due to that, there is such a possibility that the projections V1 and V3 at the both ends of the retaining ring 50E float from the holes Q1 and Q2 of the fixing roller 7.

Third Embodiment

Although the first hole Q1 (Q1A) is provided singularly through the outer circumference 76 of the fixing roller 7 as the hole portion for fitting the first and second projections U1 (U1A) and U2 (U2A) in the first and second embodiments, it is also possible to form two separate holes as the hole portion through the outer circumference of the fixing roller 7. That is, it is also possible to arrange the fixing apparatus 100 so as to fit these first and second projects U1 (U1A) and U2 (U2A) into the separate holes formed through the fixing roller 7. Still further, although the fixing apparatus of the electromagnetic inductive heating system has been explained in the embodiments, the image heating apparatus, the bearing mounting structure and the retaining ring of the invention are effective also in a fixing apparatus adopting other heating systems such as a halogen heater.

The invention may be also widely used for a sheet conveying apparatus that conveys recording members in a printing machine, a printer and an image forming apparatus, such as a curl removing apparatus that improves quality of recording members, an apparatus that applies gloss to recording members and a recording member drying apparatus that heats and dries a recording member before a toner image is formed.

Still further, the bearing mounting structure and the retaining ring of the invention may be widely used in general-purpose machines, other than the fixing apparatus of the invention, in which a bearing is positioned on a thin pipe. The usage of the retaining ring of the invention is not limited to the fixing apparatus as long as the usage is to position and restrict a member held on a rotary or stationary shaft in an axial direction thereof.

The invention can be carried out also by other embodiments in which a part or whole of the configuration of the embodiments is replaced with other configuration as long as the retaining ring is attached to the end portion of the thin heating roller to position the bearing portion.

Therefore, the pressure rotary member may be a belt member or a roller member as long as the image heating apparatus has the nip portion for heating the recording member formed by press-contacting the pressure roller with the heating roller. The heating method of the heating roller is not also limited to be the induction heating and may be resistance heating or infrared radiation heating. The image forming apparatus that mounts the image heating apparatus may be carried out regardless of types of the image forming apparatus such as charging-type, exposure-type, developing-type, tandem/one drum-type, intermediate and transfer-type/recording member conveying-type/sheet conveying-type apparatuses. While only the main part related to forming and/or transfer of the toner image have been explained in the embodiments described above, the invention may be carried out in various uses such as a printer, various printing machines, a copier, a facsimile, a compound machine and others by adding required units, devices and casing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-140350 filed on Jun. 24, 2011 which is hereby incorporated by reference herein in its entirety.

What is claimed is:

1. An image heating apparatus, comprising:

a heating roller configured to heat a toner image on a sheet and provided with a through hole formed through an axial end portion thereof;

a bearing rotatably supporting the heating roller at an outer surface of the heating roller;

a heat insulating bush fitted between the outer surface of the heating roller and the bearing; and a retaining ring configured to retain a position of the heat insulating bush relative to the heating roller in an axial direction of the heating roller, the retaining ring including:

a body formed into a substantially C-shape;

a first end portion projecting inwardly at one circumferential end of the body to fit into the through hole of the heating roller; and a second end portion projecting inwardly at the other circumferential end of the body to fit into the through hole of the heating roller.

2. The image heating apparatus according to claim 1, wherein a tip of the first end portion and a tip of the second end portion are formed into a shape to project inwardly toward the inner surface side of the heating roller, respectively.

3. The image heating apparatus according to claim 2, wherein the heating roller further includes another through hole formed in the axial end portion thereof, wherein the body of the retaining ring further includes a projecting portion projecting inwardly to fit into the another through hole of the roller, and wherein a tip of the projecting portion is formed into a shape turning toward the inner surface side of the heating roller.

4. The image heating apparatus according to claim 2, wherein the heating roller further includes two through holes each formed in the axial end portion thereof respectively, wherein the body of the retaining ring further includes two projecting portions each projecting inwardly to fit into the two through holes of the roller respectively, and wherein the tip of the two projecting portions are formed into a shape turning toward the inner surface side of the heating roller.

5. The image heating apparatus according to claim 1, further comprising a driving gear provided on the other axial end portion of the heating roller and configured to receive a driving force for rotating the heating roller.

6. The image heating apparatus according to claim 1, further comprising an excitation coil disposed within the heating roller and configured to generate magnetic flux for electromagnetic induction heating of the heating roller.

7. The image heating apparatus according to claim 1, further comprising a magnetic flux suppressing member disposed within the heating roller and configured to suppress the magnetic flux toward a predetermined region of the heating roller in a circumferential direction of the heating roller, wherein the magnetic flux suppressing member is rotatable between the inner surface of the heating roller and the excitation coil in the circumferential direction.

8. The image heating apparatus according to claim 1, wherein the retaining ring is formed into a plate-like.

* * * * *